US006722516B1

(12) United States Patent
Zelko

(10) Patent No.: US 6,722,516 B1
(45) Date of Patent: Apr. 20, 2004

(54) TRANSPORT CONTAINER WITH A CONNECTION UNIT FOR REMOVABLY CONNECTING SIDE WALLS

(75) Inventor: Johannes Zelko, Pettenbach (AT)

(73) Assignee: Steiner Technology GmbH, Ebensee (AU)

( * ) Notice: Subject to any disclaimer, the term of this patent is extended or adjusted under 35 U.S.C. 154(b) by 0 days.

(21) Appl. No.: 09/743,009

(22) PCT Filed: Jun. 25, 1999

(86) PCT No.: PCT/AT99/00168

§ 371 (c)(1),
(2), (4) Date: Feb. 23, 2001

(87) PCT Pub. No.: WO00/01586

PCT Pub. Date: Jan. 13, 2000

(30) Foreign Application Priority Data

Jun. 30, 1998 (AT) ..... 1134/98

(51) Int. Cl.[7] ..... B65D 6/26; B65D 6/18
(52) U.S. Cl. ..... 220/7; 220/4.28
(58) Field of Search ..... 220/6, 7, 4.28, 220/4.33, 326; 206/600

(56) References Cited

U.S. PATENT DOCUMENTS 3,973,692 A 8/1976 Cloyd
5,632,392 A * 5/1997 Oh ..... 220/7
5,829,617 A * 11/1998 Umiker ..... 220/6
5,853,099 A 12/1998 Lessard
6,073,790 A 6/2000 Umiker
6,293,418 B1 * 9/2001 Ogden et al. ..... 220/7

FOREIGN PATENT DOCUMENTS

| | | |
|---|---|---|
| DE | G 91 13 549.4 U1 | 4/1992 |
| DE | 297 23 107 U1 | 4/1998 |
| EP | 0 685 402 A1 | 12/1995 |
| FR | 2 545 065 A1 | 11/1984 |
| GB | 1 215 049 | 12/1970 |

* cited by examiner

*Primary Examiner*—Lee Young
*Assistant Examiner*—Joseph C. Merek
(74) *Attorney, Agent, or Firm*—Alston & Bird LLP

(57) ABSTRACT

The invention relates to a transport container (2), in particular made from a synthetic material, having a base (3) and at least two side walls (6) pivotally joined to the base (3) by hinge mechanisms (11), and having a connecting mechanism (12) arranged in an overlap region between an end face (26) of a side wall (6) and an internal face (7) of the other side wall (6) for detachably connecting the side walls (6), acting against the automatic release of the connecting mechanism (12), the locking mechanism (16) being provided as a latching element (18) mounted so as to be displaceable in a side wall (6) and joined to the side wall (6) by at least one elastically deformable retaining arm (17) and displaceable thereby from a locking into a releasing position in the connecting mechanism (12).

15 Claims, 4 Drawing Sheets

36
27
18
38
37
33
15
19
17
32
40
15
14
23
29
39
37
4
38
29
29
10
40

6
36
5
14
26
23
2
7
27
18
30
34
7
31
3
28
12
25
13
16
24
15
10
19
17
35
4
6
15
15

TRANSPORT CONTAINER WITH A CONNECTION UNIT FOR REMOVABLY CONNECTING SIDE WALLS

The invention relates to a container of the type having a base and at least two side walls pivotally joined to the base by hinge mechanisms, and having a connecting mechanism arranged in an overlap region between an end face of a side wall and an internal face of the other side wall for detachably connecting the side walls, extending more or less perpendicular to the base when in the packing position, and having means which act against the automatic release of the connecting mechanism.

Containers of this type are preferably of a fold-down or collapsible design so that they take up a minimum of space when transported in the empty state.

Several ready-made transport containers are known in which the side walls are attached with locking mechanisms. These locking mechanisms are usually provided in the form of catch systems whereby a projection locates in a specially provided locating orifice, requiring a relatively large amount of force to fix the side walls to one another. These retaining elements are not of the type in which one of the two retaining elements can be elastically deformed to facilitate closing and opening of the locking mechanisms.

DE 91 13 549 U describes a collapsible box having a pivot stop for collapsible side walls which are joined to the base by hinges. This collapsible box has elastically deformable latching elements on two of its side walls, designed to retain the side walls in their position of use or upright position. The disadvantage of this design is that the elastically deformable latching elements can only be operated from the interior of the container and are therefore difficult to access when the container is full.

The objective of the invention is to propose a container in which the side walls can be locked with one another by means of elastically deformable locking elements integrated in the structure of the side walls, these side walls being locked to prevent them from pivoting relative to another other side wall, and in which the lock can be released again in the easiest possible way using one hand.

This objective is achieved by the invention by providing the transport container with a connection mechanism that includes a locking mechanism having a latching element mounted so as to be displaceable in a side wall and joined to the side wall by at least one elastically deformable retaining arm, by means of which it can be displaced from a locking into a releasing position in the connecting mechanism. The two side walls or the base and one side wall can be locked or released by elastically displacing the retaining arm or by displacing the retaining arm along a plane formed by the side wall.

Another advantageous embodiment, the retaining arm is designed integrally with the latching element formed as a single component and provides the locking action as well as the elastic bending action.

An embodiment of the invention offers an advantage in that, being of a flat design, the locking face lies flat against the other side wall enabling the two side walls to be locked together.

According to another advantageous embodiment of the invention, the retaining arm may extend in an angular position relative to the base between the internal surface and the external surface, so that stability-enhancing features of the side walls can adapted.

The invention in an embodiment offers an advantage because each of the two side walls can be locked without any clearance relative to the other side walls, making the design of the transport container stronger.

Another advantageous embodiment has the locking mechanism provided as a single component formed integrally on the container wall and its design is such that it can simultaneously lock two side walls together.

In an advantageous embodiment, the locking device or retaining arm is securely mounted in the reinforcing ribs by means of an orifice provided in the reinforcing ribs.

Another advantageous embodiment is described, in which an orifice is provided in the side wall incorporating the locking device to ensure that the latching element can be sufficiently displaced or elastically deformed.

Also described is another advantageous embodiment ensuring that a sufficient portion of the retaining arm is free to be deformed so that the lock between the side walls can be reliably released.

An advantage is to be had from an embodiment of the invention, since the side walls to be locked to one another form a flush region with no parts protruding out from the side walls and the side walls are also locked with one another so that the lock-fit is prevented from working loose.

In accordance with other advantageous embodiment, the retaining arm or the latching element is guided in a linear motion between two reinforcing ribs incorporating orifices so that a force acting perpendicular to the side wall plane is converted into a force acting parallel with the longitudinal extension of the side wall.

Also described are preferred procedures for releasing the lock between two side walls.

Still another embodiment guarantees that the locking mechanism provides a lock-fit without any clearance.

The invention in an embodiment enables the locking mechanism or the retaining arm to deform perpendicular to the side wall plane and simultaneously prevent any deformation in the locking mechanism or the retaining arm parallel with the side wall plane.

The specification also describes other advantageous embodiments of lands forming the latching element, intended to provide an adequately strong design of these lands and the retaining arm.

BRIEF DESCRIPTION OF THE DRAWINGS

Of these.

DETAILED DESCRIPTION OF PREFERRED EMBODIMENTS

Figure 1:
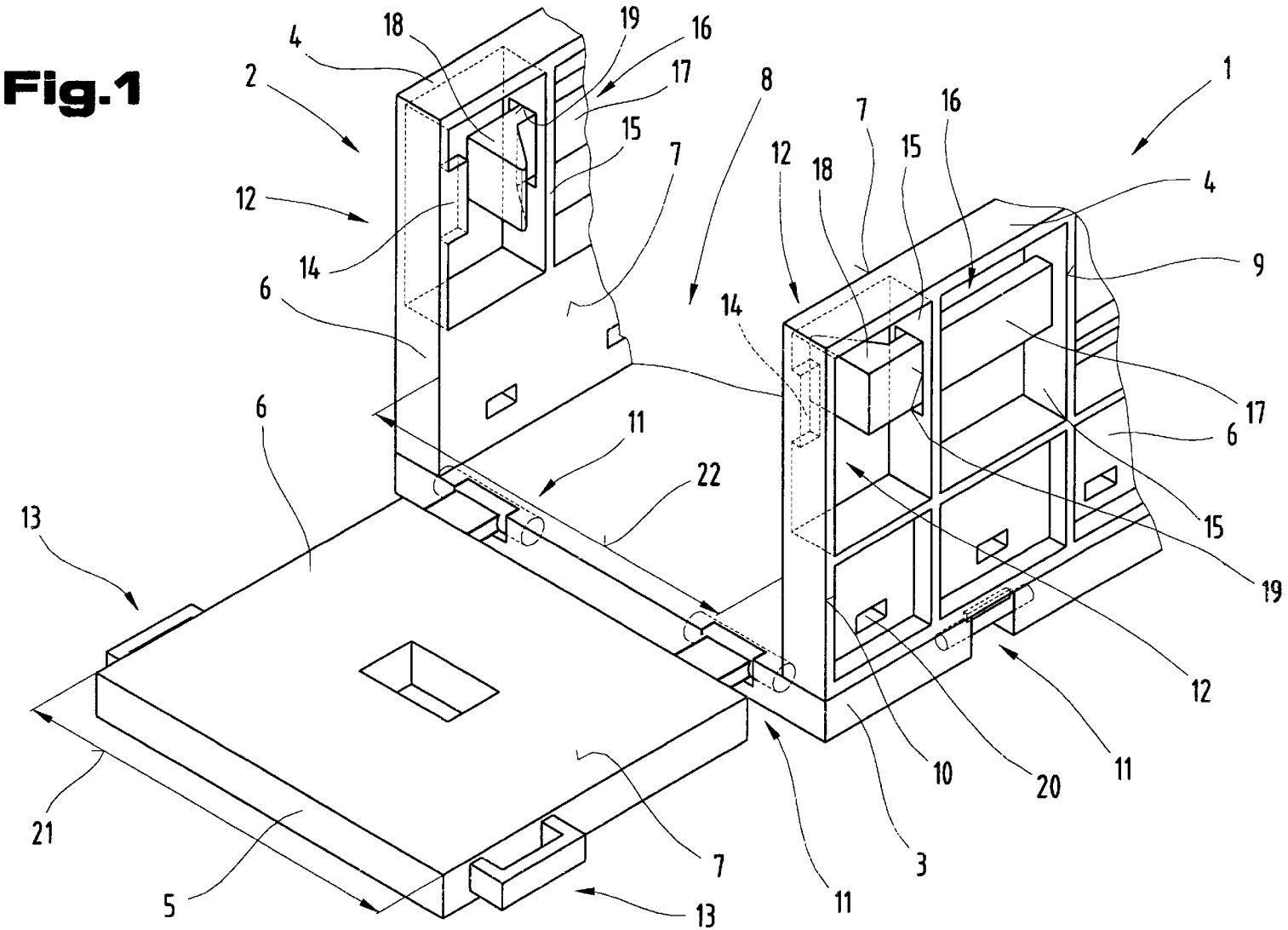
FIG. 1 is a schematic diagram of a transport container provided with the locking system proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a container 1, in particular an erect transport container 2. This erect transport container 2 consists of a base 3, two facing longitudinal side walls 4 and two facing transverse side walls 5 perpendicular to these two longitudinal side walls 4, forming side walls 6 which are able to pivot relative to one another. For the sake of clarity, the second transverse side wall 5 running parallel with the first transverse side wall 5 has been left out of the drawing in FIG. 1. The longitudinal side walls 4 and the transverse side walls 5, that is to say the side walls 6, have facing internal faces 7 which, when the side walls 6 are swung up at an angle to the base 3 or are in a position perpendicular to the base 3, form an interior 8 for receiving various objects to be transported. Opposing the internal faces 7, external faces 9 of the side walls 6 form a side wall plane 10 extending parallel with the side walls 6. Basically, it should be pointed out that the transverse side walls 5 and the longitudinal side walls 4 or the side walls 6 do not necessarily have to be arranged perpendicular to one another and may an interior 8 may be bounded by at least three side walls 6.

The longitudinal side walls 4 and the transverse side walls 5 or the side walls 6 are joined by means of hinge mechanisms 11 so that they can be pivoted in an angular position relative to the base 3.

This being the case, these hinge mechanisms 11 may be of any possible known design that would enable the side walls to be pivoted across a range of from 0° to 270°.

In order to fix the side walls in their position extending perpendicular to the base 3, a connecting mechanism 12 is provided in the end face regions of the side walls 6, which is designed to fix the side walls 6 in their upright position ready for packing. These connecting mechanisms 12 consist of coupling seats 13 on side walls 6 or in this case on transverse side walls 5, matching coupling elements 14 provided in the other side walls 6 or in the longitudinal side walls 4. The coupling seat 13 is formed by three stems extending perpendicular to one another integrally joined to an end face wall, which in this case happens to be the side wall 6 shown as the transverse side wall 5. As a result of this design, the stems of the coupling seat 13 in conjunction with the end face wall of the side wall 6 form a cavity for receiving the coupling element 14 used for locking purposes. In order to enhance resistance to bending, the side walls 6 are provided with reinforcing ribs 15 across their entire extension, which reinforcing ribs 15 may be provided in a horizontal or vertical direction.

Provided in the side walls 6 or in the longitudinal side walls 4 are locking mechanisms 16 with latching elements 18 which can be displaced by means of an elastically deformable retaining arm 17. This locking mechanism 16 or the retaining arm 17 extends parallel with a longitudinal section of the side wall 6 in which it is housed, being integrally formed on a reinforcing rib 15 running perpendicular to the longitudinal extension of the side wall 6. Another reinforcing rib 15, extending in the direction of the latching element 18 at a distance from the first reinforcing rib 15 and parallel with the first reinforcing rib 15, has an orifice 19 providing a movable bearing for the retaining arm 17. In addition, the retaining arm 17 projects through the orifice 19 of the other reinforcing rib 15 and the orifice 19 forms a guiding system for an end region of the retaining arm 17 forming the latching element 18. Furthermore, in the region between the wall edge and the reinforcing rib 15 in which the orifice 19 is disposed, the side wall 6 has an orifice which enables the latching element 18 to move freely in a direction perpendicular to the side wall plane 10. As may be seen from FIG. 1, the locking mechanism 16 is fully integrated in the structure of the longitudinal side wall 4 or the side wall 6 on which it is provided, avoiding any undesirable projection beyond the side wall planes 10 formed by the side walls 6 and thereby saving space when the transport containers 2 are stacked in the packing position adjacent to one another.

Basically, it should be pointed out at this stage that the coupling seat 13 and the locking mechanism 16 may be provided on all side walls 6 of the transport container 2, thereby enabling the side walls 6 to be placed upright in a packing position at an angle to the base 3.

Moreover, all side walls 6 may have orifices 20 distributed across their surface, which will help to vent the transported goods. Basically, a width 21 of the transverse side wall 5 is the same size as or slightly smaller than an orifice width 22, spacing two longitudinal side walls 4 apart from one another when in the position perpendicular to the base 3. This means that when the transverse side wall 5 is also pivoted into a position perpendicular to the base, the coupling seat 13 can be inserted into the locking mechanism 16 by slightly deforming the longitudinal side walls 4.

As illustrated in FIG. 1, the locking mechanism 16 has a latching element 18 mounted so that it can be displaced by means of an elastically deformable retaining arm 17 mounted in a side wall 6 and/or the base 3, so that when the side walls in are in the packing position, at least one of the side walls 6 is locked to prevent it from pivoting relative to another side wall 6. The latching element 18 is joined to the side wall 6 by means of at least one elastically deformable retaining arm 17 and can be displaced thereby from a locked position into a released position in order to release the tension force in the connecting mechanism 12. The retaining arm 17 essentially extends between the internal face 7 and the external face 9 and parallel therewith and parallel with the base 3 and the connecting mechanism 12 widens facing the latching element 18. As may also be seen, the latching element 18 is arranged on an end region of the retaining arm 17 remote from the reinforcing rib 15 and the latching element 18 is designed to have lands. Also arranged in the side walls 6 is at least one reinforcing rib 15 running perpendicular to the retaining arm 17 and provided with the orifice 19 for receiving or guiding the elastically deformable retaining arm 17. In the region of the latching elements 18, apertures or orifices are also provided in the side walls 6 enabling the latching element arranged on the end region of the retaining arm 17 facing the other side wall 6 to move freely, so that the coupling element 14 projects into this aperture or into this orifice parallel with the longitudinal extension of the side wall and in the direction of the latching element 18.

Figure 3:
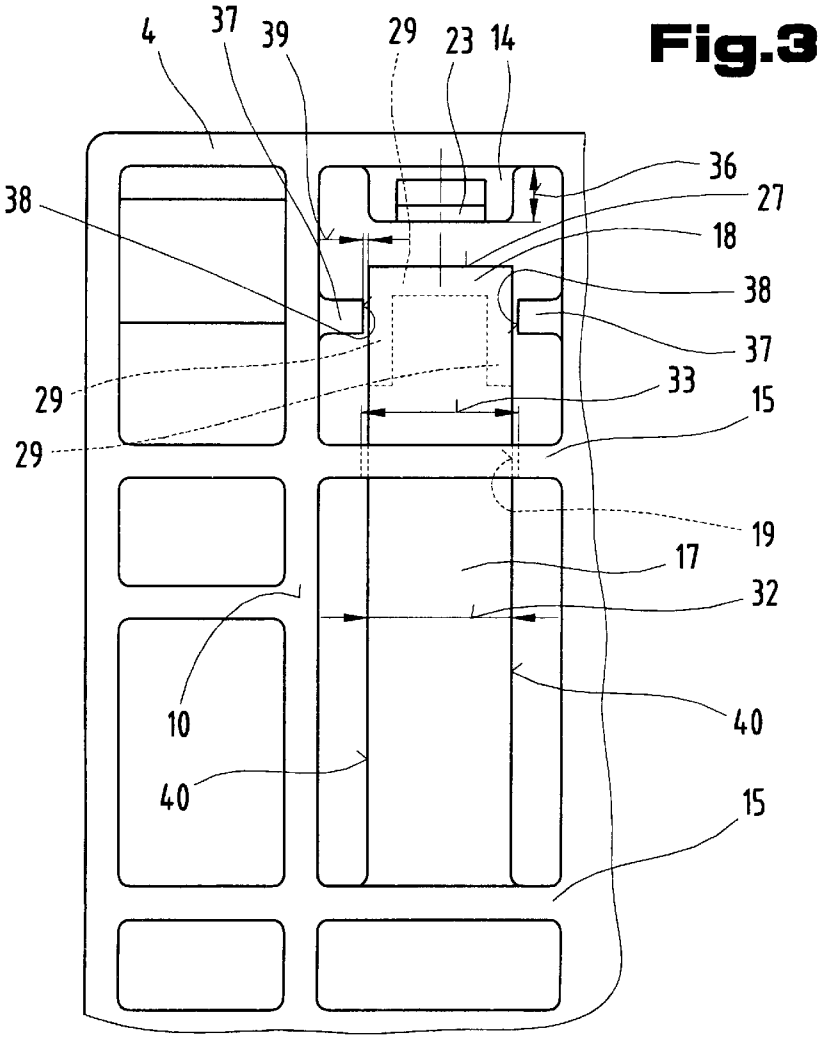
FIG. 3 is a diagram of the side walls of the transport container locked to one another, viewed along arrow III of FIG. 2.
Figure 2:
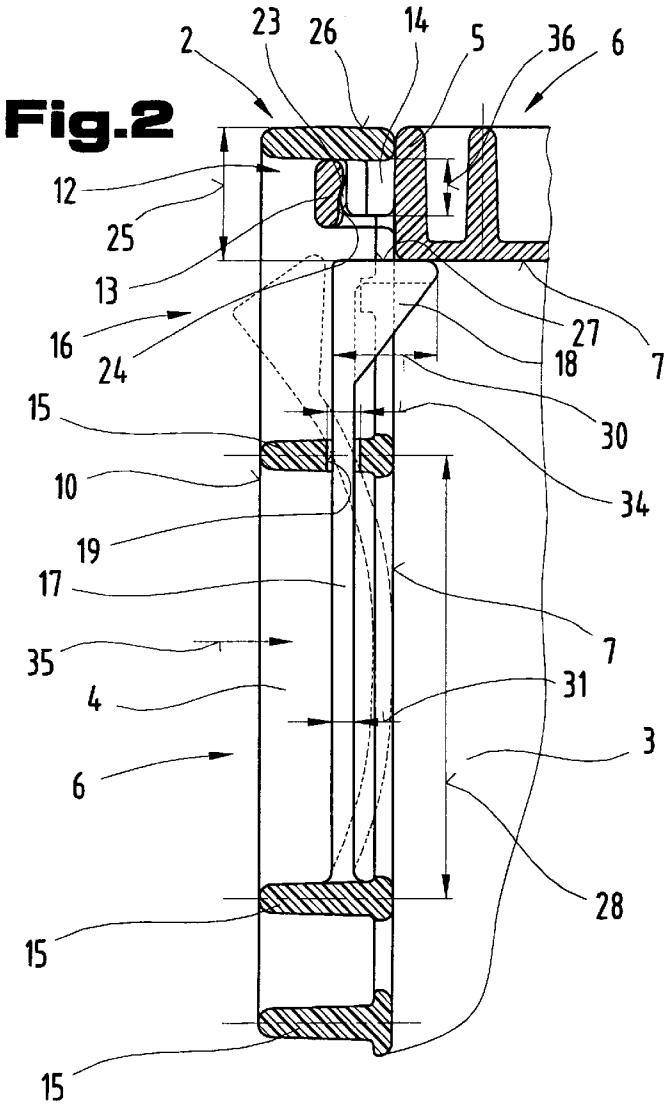
FIG. 2 is a plan view in section of two side walls of the transport container locked to one another.

FIGS. 2 and 3, which will be described together, depict a part-region of the transport container 2 having the coupling seat 13 and the locking mechanism 16, in section in a plan view and from a side view. As may be seen, when two side walls are locked in position in the packing position, the coupling seat 13 is fully located around the coupling element 14 extending in the towards the latching device 16. In addition, the coupling element 14 has a section of raised material 23 which corresponds to a recess 24 matching this raised material 23 in the coupling seat 23. This raised material 23 and the recess 24 are designed so that when the coupling seat 13 is applied, it snaps onto the coupling element 14, thereby securely preventing the fixing of the transverse side wall 5 from inadvertently coming loose from the longitudinal side wall 4. Provided at a distance 25 from an end face 26 of the peripheral edge of the longitudinal side wall 4 is a locking surface 27 of the latching element 18. The latching element 18 is integral with the retaining arm 17 and forms a locking surface 27 running more or less perpendicular to the longitudinal extension of the retaining arm 17 facing the connecting mechanism 12. This distance 25 more or less corresponds to a thickness of the transverse side wall 5, so that the transverse side wall 5 does not project undesirably beyond the end face 26 of the longitudinal side wall 4. Adjoining the latching element 18 in the direction of the first reinforcing rib 15 is the elastically deformable retaining arm 17, being formed, at its end region remote from the latching element 18, integrally with the reinforcing rib 15 extending in the side wall 6 perpendicular to the longitudinal extension of the first.

As may also be seen, a second reinforcing rib 15 is arranged across the longitudinal extension of the retaining arm 17, having an orifice 19 for receiving or guiding the retaining arm 17, and likewise running perpendicular to a longitudinal extension of the retaining arm 17. This second reinforcing rib 15 is spaced at a distance 28 from the first reinforcing rib 15, the distance 28 being selected so that the latching element 18 is guaranteed to pivot when the retaining arm 17 is deformed. It is of advantage if the distance 28 between the reinforcing ribs 15 corresponds to approximately ⅔ of the total length of the retaining arm 17 between a connecting point with the reinforcing rib 15 and the locking surface 27 of the latching element 18. Furthermore, a distance between the end face 26 and side wall 6 and the locking surface 27 of the latching element 18 corresponds more or less to a thickness of the side wall 6.

Clearly, it would also be possible for the retaining arm 17 to be arranged in its latching element 18 at any angular position relative to the base 3, so as to adapt any strength-enhancing features in the side walls 6.

The latching element 18 is provided in the form of lands 29 and is of a thickness 30, measured perpendicular to the side wall plane 10, which is bigger than a thickness 31 of the retaining arm 17. The latching element is designed to have at least one land 29 projecting across a surface of the retaining arm 17, the land 29 and the side lands on the retaining arm 17 being of an integral design. The thickness 30 of the latching element 18 is selected so that an end region of the latching element 18 facing the coupling element 14 projects beyond the internal face 7 of the side wall 6 or the longitudinal side wall 4, so that a locking surface 27 of the latching element 18 lies against the internal face 7 of the other side wall 6 or the transverse side wall 5 to produce a pre-tensing force, thereby producing a lock-fit between the two side walls 6.

Clearly, it would also be possible to leave a distance between the locking surface 27 of the latching element 18 and the internal face 7 of the side wall 6, in order to allow for a slight degree of movement of the side wall 6.

The retaining arm 17 or the latching element 18 has a width 32, measured parallel with the side wall plane 10, which is slightly smaller than orifice width 33 of the orifice 19. Furthermore, an orifice thickness 34 of the orifice 19 is slightly larger than the thickness 31 of the retaining arm 17. As a result of this advantageous embodiment, the retaining arm 17 incorporating the latching element 18 is arranged or mounted so that it is moveable in the second reinforcing rib 15.

As mentioned briefly above, the retaining arm 17, formed integrally with the first reinforcing rib 15 and incorporating the latching element 18 remote from the first reinforcing rib 15, is of an elastically deformable design and when force is applied—in the direction of arrow 35—the retaining arm 17 can be deformed, as illustrated by the retaining arm 17 depicted in the drawing by broken lines. For this reason, an orifice thickness 34 is selected so that when force is applied in the intermediate region between two reinforcing ribs 15—in the direction of arrow 35—the latching element 18 is able to pivot in the direction of the external face 9 of the side wall 6 housing the locking mechanism 16. Due to this pivoting movement of the latching element 18, the other side wall 6 or the transverse side wall 5 is released from the locking mechanism 16 enabling the transverse side wall 5 to be pivoted in the direction of the retaining arm 17. The connection between the two side walls 6 is released by swinging the transverse side wall 5 outwards by an amount corresponding to a length 36 of the coupling element 14, so that the coupling seat 13 is displaced from a position in which it engages round the coupling element 14 into a position in which it releases it. The longitudinal side wall 4 can then be moved away from the transverse side wall 5, as a result of which the transverse side wall 5 can be pivoted into a position in a flat plane with the base 3 or into any other position at an angle to the base 3. When force is applied—in the direction of arrow 35—the portion of the retaining arm 17 between the reinforcing ribs 15 extends in length so that the distance 25 is lengthened, thereby preventing the latching element 18 from swinging into a position in which the transverse side wall 5 would be released.

Extending adjacent to the retaining arm 17 or the latching element 18, in a direction parallel with the side wall plane 10, are two projections 37, having end faces 38 spaced at a slight distance 39 back from narrow sides 40 of the retaining arm 17. The judicious arrangement of the projections 37 provides an additional guide for the latching element 18, thereby securely preventing the retaining arm 17 from inadvertently pivoting in a direction parallel with the side wall plane 10.

The retaining arm 17 is mounted in the side wall 6 as follows. The retaining arm 17 extends parallel with the longitudinal extension of the side wall 6 in the direction of another side wall 6. In this end region facing the side wall 6, the retaining arm is of a greater thickness 30, so that this latching element 18 projects beyond the internal face 7 of the first side wall 6, thereby enabling the other side wall 6 to be locked. In the end region remote from the latching element 18, the retaining arm 17 is formed integrally on a first reinforcing rib 15 running perpendicular to the longitudinal extension of the side wall 6. A second reinforcing rib 15, arranged parallel with the first reinforcing rib 15 and at a distance 28 apart in the direction of the connecting mechanism 12, is provided with an orifice 19 so that the retaining arm 17 can be moveably mounted, the dimensions of the retaining arm 17 being slightly smaller than the dimensions of the orifice 19 receiving or guiding the latching element 18. The orifice 19 is also designed so that the retaining arm 17 can be elastically deformed so as to move from a first position in which the side wall 6 or the transverse or longitudinal side wall 5, 4 is fixed, into a second position in which the transverse or longitudinal side wall 5, 4 is released. The second reinforcing rib 15 therefore forms a mounting point, parallel with a side wall plane 10 formed by the side wall 6, in which the retaining arm 17 can be pivotally retained.

Figure 5:
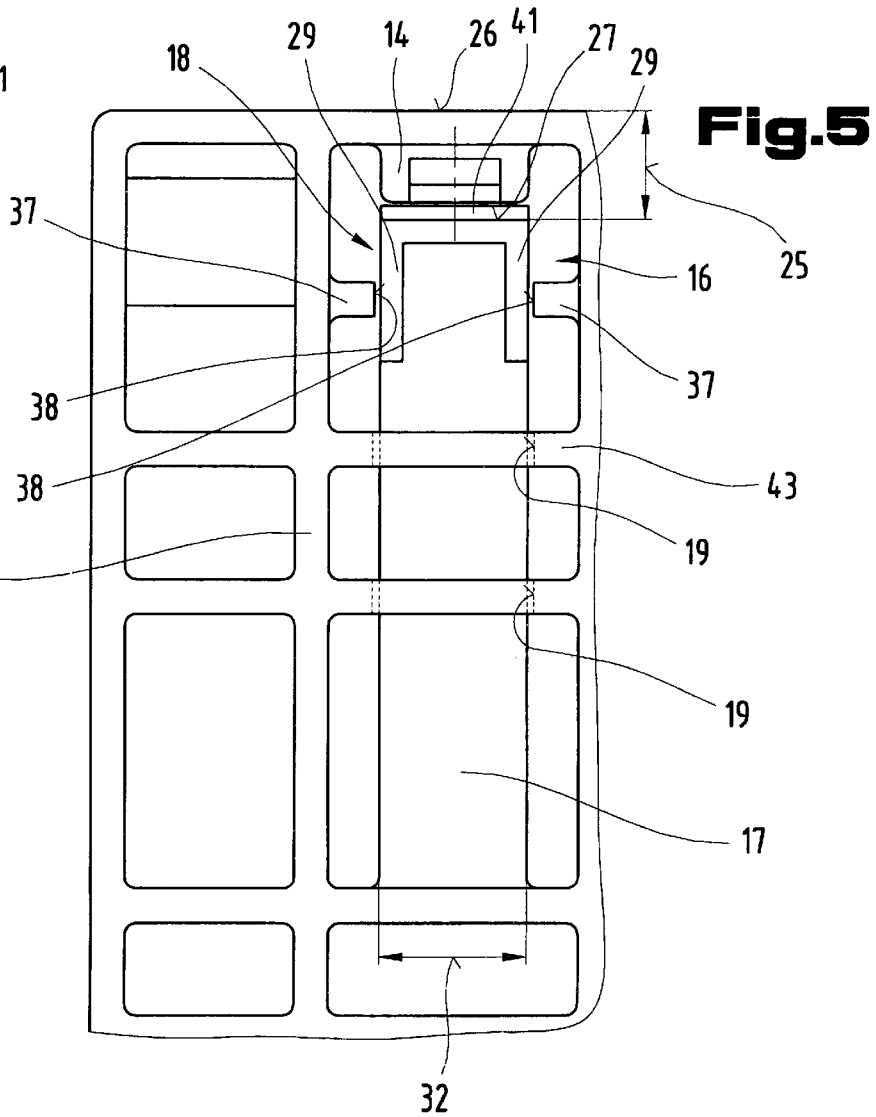
FIG. 5 is a view of the locking system illustrated in FIG. 4, seen along the arrow V of FIG. 4.
Figure 4:
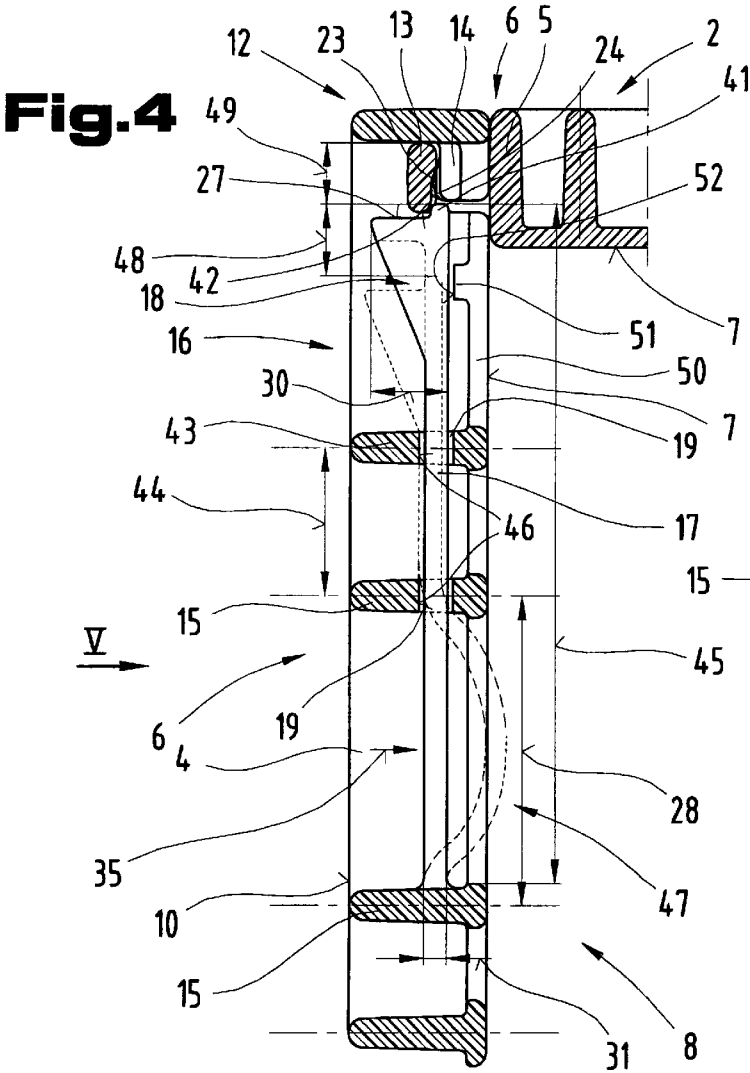
FIG. 4 is a plan view in section of another embodiment of the locking system.

FIGS. 4 and 5 illustrate another embodiment of the connecting mechanism 12 between two side walls 6 of the transport container 2, the same reference numbers being used to denote the same parts as those in the other drawings.

The connecting mechanism 12 is again shown with the transverse side wall 5 in the position in which it is locked with the longitudinal side wall 4, the coupling seat 13 being fully engaged around the coupling element 14 and the raised material 23 of the coupling element 14 locating in the recess 24 of the coupling seat 13. In this embodiment, the transverse side wall 5 is definitively locked in the longitudinal side wall 4 by means of the locking mechanism 16, which again has a retaining arm 17 formed integrally on a first reinforcing rib 15 extending perpendicular to the longitudinal extension of the side wall 6. A latching element 18 is again provided on the end region of the retaining arm 17 remote from this connection, the thickness 30 of which is bigger than a thickness of the retaining arm 17. On its locking surface 27, this latching element 18 has a projection 41, which projects inside the interior of the coupling seat 13 formed by the stems.

In this embodiment, the locking surface 27 does not move to bear against the internal face 7 of the transverse side wall 5 but in this particular case lies against an end face 42 of the coupling seat 13. A second reinforcing rib 15 is again provided in order to mount the retaining arm 17 in the side wall 6 and is arranged at a distance 28 from the first reinforcing rib 15.

In this embodiment, the lands 29 of the latching element 18 extend in the direction of the side wall plane 10 and not in the direction of the transverse side wall 5, as a result of which the locking surface 27 of the latching element 18 comes into contact with the coupling seat 13, checking it in its locked position. Clearly, it would also be possible to provide a gap between the locking surface 27 and the coupling seat 13 in order to make it easier to pivot the latching element 18. It would also be possible to dispense with the projection 41 since the locking action can be effected by the locking surface 27 alone.

Another reinforcing rib 43 is provided in the structure of the side wall 6, running parallel with and adjacent to the second reinforcing rib 15, the purpose of which is to guide the retaining arm 17 in the longitudinal direction. Like the second reinforcing rib 15, this reinforcing rib 43 also has an orifice 19, which is also provided as a means of guiding the retaining arm 17 with the latching element 18 into the mounting. This reinforcing rib 43 is spaced at a distance 44 from the second reinforcing rib 15, which distance 44 may be selected depending on a total length 45 of the retaining arm 17. Through the structure of the side wall 6, another reinforcing rib 43 also having an orifice 19 for the retaining arm 17 is provided, parallel with and adjacent to the reinforcing rib 15 having the orifice 19, the immediately adjacent ribs 15, 43 providing a guide track 46 to guide the end region of the retaining arm 17 incorporating the latching element 18 in a linear direction.

Due to the structure of the retaining arm 17 or the integral design with the first reinforcing rib 15 and due to the mounting in the second reinforcing rib 15 and the other reinforcing rib 43, the retaining arm 17 or the latching element 18 is mounted so that it can slide linearly across a guide track 46 formed by the reinforcing ribs 15, 43, parallel with the side wall plane 10 formed by the side wall 6. If a force is applied—in the direction of arrow 35—to the retaining arm 17 between the first reinforcing rib 15 and the second reinforcing rib 15, the latter is deformed towards the interior 8 of the transport container 2 due to its elastic properties.

The latching element 18 is prevented from swinging in the direction of the side wall plane 10 because of the guide track 46 provided by the two reinforcing ribs is, 43 and the retaining arm 17 or the latching element 18 is forcibly guided in a linear motion. The advantage of this design is that when the lock is released or the retaining arm 17 elastically deformed, the latching element 18 does not project beyond the side wall plane 10 and therefore prevents the latching element 18 or the retaining arm 17 from undesirably hooking in to adjacent containers. The lock is released by applying a compression force to the retaining arm 17—in the direction of arrow 35—in the region between the reinforcing ribs 15 so that the end region of the retaining arm 17 incorporating the latching element 18 is displaced in the direction of the longitudinal extension of the retaining arm 17 and the distance 25 between the end face 26 and the locking surface 27 is lengthened.

Advantageously, the retaining arm 17 is designed so as to be resistant to bending in a plane extending parallel with the internal face 7 of the side wall 6, securely preventing the retaining arm 17 from being deformed in the direction of the side wall plane 10. It should be pointed out that a total length 45 and a width 32 of the retaining arm 17 is a multiple of a thickness 31 of the retaining arm 17.

Because the retaining arm 17 deforms in the region between the first reinforcing rib 15 and the second reinforcing rib 15, the length of a retaining arm section 47 is altered or lengthened such that the latching element 18 is displaced by the linear displacement to a position in which the coupling seat 13 of the connecting mechanism 12 is released. This is achieved by the fact that a displacement path 48 of the latching element 18 from the position illustrated by a solid line into the position illustrated by broken lines is the same as or greater than a width 49 of the coupling seat 13.

The linear displacement of the latching element 18 or a section of the retaining arm 17 is made possible because the retaining arm 17 is designed to be deformable perpendicular to the side wall plane 10 formed by the side wall 6 and this deformation causes the retaining arm section 47 of the retaining arm 17 to be lengthened and this elastic deformation is converted into a linear displacement of the latching element 18 via the mounting of the retaining arm 17 in the second reinforcing rib 15 and the reinforcing rib 43.

In order to guide the retaining arm 17 or the latching element 18 more accurately, a projection 51 is provided on an inner portion 50 of the longitudinal side wall 4, an end face 52 of the projection 51 lying against the retaining arm 17 or set back at a slight distance so that the retaining arm 17 or the latching element 18 is guided in a direction perpendicular to the longitudinal extension of the side wall 6.

Figure 6:
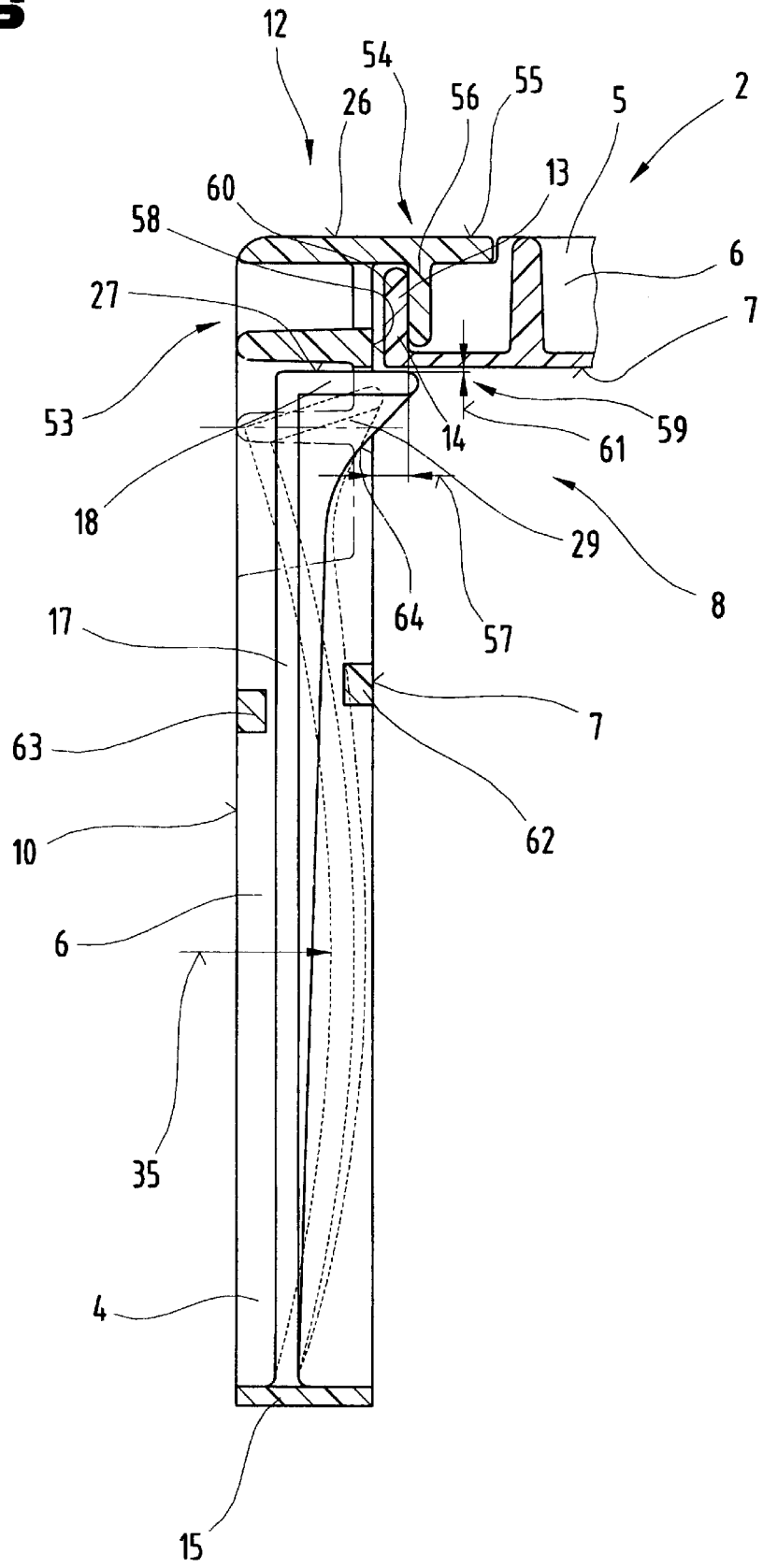
FIG. 6 is a plan view, in section, of another embodiment of the locking system.

FIG. 6 illustrates another embodiment of the connecting mechanism 12 for connecting side walls 6 of the transport container 2, seen in section in a plan view, the side wall 6 this time being a longitudinal side wall 5 and the other side wall being a longitudinal side wall 4. It should be pointed out that the connecting mechanism 12 and the retaining arm 17 may be provided in any side wall 6, i.e. in the longitudinal side wall 4 or in the transverse side wall 5.

As may be seen from the drawing, the longitudinal side wall 4 has a projection 54 projecting beyond the internal face 7 of the longitudinal side wall 4 in an end region 53 remote from the transverse side wall 5. Advantageously, an external face 55 of the projection 54 is in a same plane as the end face 26 of the longitudinal side wall 4 so that the projection 54 does not protrude awkwardly beyond the transverse side wall 5. The projection 54 is formed integrally on the longitudinal side wall 4 and has a land 56 projecting towards the interior 8 which forms the coupling seat 13 in this embodiment of the connecting mechanism. A distance 57 arranged between the internal face 7 of the longitudinal side wall 4 and the land 56 or the coupling seat 13 provides a latch compartment 48 in this region to receive any coupling element 14 which might be provided.

Provided on an end region 59 of the transverse side wall 5 facing the longitudinal side wall 4 is a land 60 forming the coupling element 14, this land 60 or coupling element 14 being directed in a direction opposite the land 56 or coupling seat 13. With a coupling element 14 or land 60 of this design, the coupling element 14 is able to project into the latch compartment 58, securely retaining the transverse side wall 5 and the longitudinal side wall 4 and preventing stress in the longitudinal direction of the transverse side wall 5 and the longitudinal side wall 4. The coupling seat 13 and the coupling element 14 may designed in any shape, provided these shapes fulfil the intended purpose.

An elastically deformable retaining arm 17 incorporating an integrally joined latching element 18 is provided in a recess of the longitudinal side wall 4, the retaining arm 17 again being integrally joined to a reinforcing rib 15 arranged in the longitudinal side wall 4. From this connecting point with the reinforcing rib 15, the retaining arm 17 extends towards the end region 53 of the longitudinal side wall 4, the retaining arm widening in this longitudinal direction towards the interior 8 so that the latching element 18 projects beyond an internal face 7 of the longitudinal side wall 4. As a result of this advantageous embodiment, the transverse side wall 5 or the coupling element 14 is prevented from coming loose from the projection 54 of the longitudinal side wall 4 or the coupling seat 13 and transverse side wall 5 is secured so that it will not fold down into the interior 8 of the transport container 2. Advantageously, between the internal face 7 of the transverse side wall 5 and the locking surface 27 of the latching element 18, a small distance 61 is provided to prevent the latching element 18 or the retaining arm 17 from causing strain on the transverse side wall 5. Clearly it would also be possible for the locking surface 27 to bear against the internal face 7 of the transverse side wall 5 and apply a certain amount of pre-tensing force thereon, which would hold the transverse side wall securely, reducing any inherent noise of the transport container 2 during use.

The material from which the retaining arm 17 is made has elastic properties to enable the connection between the two side walls 6 or between the longitudinal side wall 5 and the transverse side wall 4 to be released. An integral supporting land 62 is provided on the internal face 7 of the longitudinal side wall 4, in a position more or less bisecting the retaining arm 17 preferably closer to the latching element 18, which extends over a part region of the thickness of the longitudinal side wall 4. If a force is applied to the retaining arm in the direction of arrow 35 by finger pressure or otherwise, the retaining arm 17 is deformed towards the interior 8 of the transport container 2 due to its deforming properties so that it is supported against the supporting land 62. Because of this support, the latching element 18 of the retaining arm 17, on the other hand, is moved towards the external face 10 of the longitudinal side wall 4 so that the connecting mechanism 12 is displaced from a locking into a release position. Since the retaining arm 17 deforms between the supporting land 62 and the reinforcing rib 15, there is also a change in length relative to the supporting land 62 in the portion of the retaining arm 17 facing the end region 53 of the end face wall 4, which relieves a pre-tensing force acting on the transverse side wall 5 or the connecting mechanism 12, in other words the distance 61 between the locking face 27 of the latching element 18 and the internal face 7 of the transverse side wall 5 is lengthened, causing the retaining arm 17 or the latching element 18 to pivot into the position indicated by broken lines.

Furthermore, a stop 63 may also be provided on the external face 10 remote from the supporting land 62, designed to prevent the entire retaining arm 17 from inadvertently swinging out beyond the external face 10 of the transverse side wall 4. Clearly because the transport container 2 and its individual components are made from a material having elastic properties, the retaining arm 17 may be integral or in a single piece with the supporting land 62 without restricting the free movement of the latching element 18. In this case, the stop 63 may be dispensed with since the external face 10 of the longitudinal side wall 4 will prevent the retaining arm 17 from inadvertently working loose.

The retaining arm 17 becomes wider as it extends towards the latching element 18 and, in the region of the latching element 18, the land 29 has an angled contour forming an angled plane or inclined plane 64 between the latching element 18 and the retaining arm 17. The particular advantage of this feature is that when the connecting mechanism 12 is released or when the transverse side wall 5 has been folded down towards the interior and the transverse side wall 5 has to be placed back upright into its position of use, no force has to be applied to the retaining arm 17. This is because when the transverse side wall 5 is swung up into its position of use, the land 60 or the coupling element 14 bears on this inclined plane 64 and the latching element 18 slips in a sliding action along this inclined plane 64 towards the external face 10 of the longitudinal side wall 4 until the coupling element 14 has passed the latching element 18 and locates in the latch compartment 58. Once the coupling element 14 is located in the latch compartment 58, the retaining arm 17 or the latching element 18 resumes its original position because of its elastic properties, producing the effect of the connecting mechanism or locking mechanism 16 proposed by the invention. As a result of this advantageous embodiment, the transport container 2 is particularly easy to use and a lot of time is saved when folding the transport container 2 flat and re-erecting it to its usage position.

For the sake of good order, it should finally be pointed out that in order to provide a clearer understanding of the structure of the connecting mechanism 12, it and its constituent parts have been illustrated out of scale to a certain extent and/or on an enlarged and/or reduced scale.

The tasks underlying the independent inventive solutions can be found in the description.

Above all, the subject matter of the individual embodiments illustrated in FIGS. 1; 2, 3; 4, 5; 6 can be construed as independent solutions proposed by the invention. The tasks and solutions can be found in the detailed descriptions relating to these drawings.

| List of reference numbers |
|---|
| 1 Container |
| 2 Transport container |
| 3 Base |
| 4 Longitudinal side wall |
| 5 Transverse side wall |
| 6 Side wall |
| 7 Internal face |
| 8 Interior |
| 9 External face |
| 10 Side wall plane |
| 11 Hinge mechanism |
| 12 Connecting mechanism |
| 13 Coupling seat |
| 14 Coupling member |
| 15 Reinforcing rib |
| 16 Locking mechanism |
| 17 Retaining arm |
| 18 Latching element |
| 19 Orifice |
| 20 Orifice |
| 21 Width |
| 22 Orifice width |
| 23 Raised material |
| 24 Recess |
| 25 Distance |
| 26 End face |
| 27 Locking surface |
| 28 Distance |
| 29 Land |
| 30 Thickness |
| 31 Thickness |
| 32 Width |
| 33 Orifice width |
| 34 Orifice thickness |
| 35 Arrow |

-continued

| List of reference numbers |
|---|
| 36 Length |
| 37 Projection |
| 38 End face |
| 39 Distance |
| 40 Narrow side |
| 41 Projection |
| 42 End face |
| 43 Reinforcing rib |
| 44 Distance |
| 45 Total length |
| 46 Guide track |
| 47 Retaining arm section |
| 48 Displacement path |
| 49 Width |
| 50 Portion |
| 51 Projection |
| 52 End face |
| 53 End region |
| 54 Projection |
| 55 External face |
| 56 Land |
| 57 Distance |
| 58 Latch compartment |
| 59 End region |
| 60 Land |
| 61 Distance |
| 62 Supporting land |
| 63 Stop |
| 64 Plane |

What is claimed is:

1. A transport container, comprising:

a base;

at least two side walls pivotally joined to the base by hinge mechanisms such that the side walls are pivotable into erected positions generally perpendicular to the base; and a connecting mechanism arranged in an overlap region between an end face of a first of the side walls and an internal face of a second of the side walls for detachably connecting the side walls in the erected positions, a locking mechanism being provided as a latching element mounted so as to be displaceable in the first side wall and joined to the first side wall by at least one elastically deformable retaining arm, the retaining arm having a fixed end and an opposite free end region that forms the latching element, the retaining arm being arranged to be displaced from a locking position into a releasing position in the connecting mechanism, and wherein the first side wall includes a first reinforcing rib proximate the fixed end of the retaining arm and a second reinforcing rib spaced a distance from the first reinforcing rib in a direction of the free end region forming the latching element, the retaining arm projecting through an orifice in the second reinforcing rib such that the second rib is disposed between the free end region of the retaining arm and the first rib, the orifice in the second reinforcing rib serving to retain the retaining arm within the orifice while an inner edge of the orifice forms a pivot surface about which the end region of the retaining arm that forms the latching element pivots to move between the locking position and the releasing position.

2. The transport container of claim 1, wherein the retaining arm extends parallel to and between an internal face and an external face of the first side wall and parallel to the base, and the latching element facing the connecting mechanism is widened.

3. The transport container of claim 1, wherein the latching element is integrally formed on the retaining arm and a locking surface extending perpendicular to a longitudinal extension of the retaining arm is provided facing the connecting mechanism.

4. The transport container of claim 1, wherein the latching element is formed at the free end of the retaining arm and the opposite fixed end of the retaining arm is joined to the first reinforcing rib.

5. The transport container of claim 4, wherein the first reinforcing rib extends generally perpendicular to a longitudinal extension of the retaining arm.

6. The transport container of claim 4, wherein a distance between the first and second reinforcing ribs corresponds to about ⅔ of a total length between a connecting point of the retaining arm with the first reinforcing rib and a locking surface of the latching element.

7. The transport container of claim 1, wherein a distance between an end face of the first side wall and a locking surface of the latching element approximately corresponds to a thickness of the first side wall.

8. The transport container of claim 1, wherein the retaining arm is arranged such that when a compression force is applied to a region of the retaining arm between the first and second reinforcing ribs in a direction toward an interior of the transport container, the end region of the retaining arm having the latching element is swung out from a plane of the first side wall toward an external face thereof.

9. The transport container of claim 1, wherein a peripheral edge forming an end face of the first side wall lies opposite a locking surface of the latching element and forms a stop surface of the connecting mechanism.

10. The transport container of claim 1, wherein the retaining arm is elastically deformable in a direction perpendicular to an internal face of the first side wall.

11. The transport container of claim 1, wherein the retaining arm is resistant to bending in a plane extending parallel with an internal face of the first side wall.

12. The transport container of claim 1, wherein a total length and a width of the retaining arm are each a multiple of a thickness of the retaining arm.

13. The transport container of claim 1, wherein the latching element comprises at least one land projecting from at least one surface of the retaining arm.

14. The transport container of claim 13, wherein the at least one land comprises a first land supported by side lands on the retaining arm.

15. The transport container of claim 14, wherein the first land and the side lands are integral with the retaining arm.

* * * * *

UNITED STATES PATENT AND TRADEMARK OFFICE

CERTIFICATE OF CORRECTION

PATENT NO. : 6,722,516 B1
DATED : April 20, 2004
INVENTOR(S) : Zelko

It is certified that error appears in the above-identified patent and that said Letters Patent is hereby corrected as shown below:

Title page,
Item [73], Assignee, "(AU)" should read -- (AT) --.

Signed and Sealed this

Twenty-seventh Day of July, 2004

JON W. DUDAS
*Acting Director of the United States Patent and Trademark Office*